United States Patent [19]

Arbree et al.

[11] Patent Number: 4,591,887

[45] Date of Patent: May 27, 1986

[54] SOLVENT RESISTANT THERMALLY PRINTABLE MATERIAL

[76] Inventors: Roberta R. Arbree, 165 Coburn Woods, Nashua, N.H. 03063; David C. Degulis, 3 Pacific Blvd., Nashua, N.H. 03062; Henry W. Goodwin, 28 West St., Milford, N.H. 03055; Norman T. Veillette, 189 Wheeler Rd., Hollis, N.H. 03049

[21] Appl. No.: 579,363

[22] Filed: Feb. 13, 1984

[51] Int. Cl.[4] ..... B41M 5/18

[52] U.S. Cl. ..... 346/200; 346/207; 346/226; 427/152; 428/138; 428/212; 428/341; 428/354; 428/913; 428/914

[58] Field of Search ..... 346/200, 207, 226, 209, 346/218, 220, 221, 224; 428/913, 914, 40, 138, 212, 341, 342, 354; 427/150–152

[56] References Cited

U.S. PATENT DOCUMENTS

| | | | |
|---|---|---|---|
| 3,906,123 | 9/1975 | Vincent et al. | 427/150 |
| 4,114,926 | 9/1978 | Habib et al. | 282/27.5 |
| 4,370,370 | 1/1983 | Iwata et al. | 428/40 |
| 4,388,362 | 6/1983 | Iwata et al. | 428/211 |
| 4,401,721 | 8/1983 | Hida | 427/151 |
| 4,424,245 | 1/1984 | Maruta et al. | 428/40 |

FOREIGN PATENT DOCUMENTS

| | | | |
|---|---|---|---|
| 0146795 | 11/1981 | Japan | 346/226 |
| 56-126193 | 6/1982 | Japan | 346/226 |

*Primary Examiner*—Bruce H. Hess
*Attorney, Agent, or Firm*—Lahive & Cockfield

[57] ABSTRACT

Disclosed is a heat-sensitive recording material useful, for example, in the manufacture of labels used in connection with the sale of meat, produce, and the like. The material comprises a cellulosic or other suitable substrate, a thermally imprintable color producing layer and a water-insoluble protective layer over the color-producing layer. It may also include a second protective layer and/or a pressure-sensitive adhesive layer on the opposite side of the substrate from the color-producing layer, and a releasable liner covering the adhesive layer. The color-producing layer has a colorless or pale leuco dye, an acidic developer for producing upon imagewise heating of the recording material, a water-soluble, polymeric binder material, and a basic, acid-neutralizing agent for reducing background discoloration. The protective layer comprises a polymeric resin, a covalent cross-linker for the resin, an acidic substance operative as a catalyst which cross-links the resin in situ, and inert filler particles operative as spacer particles. Oxygen-permeable, heat-sensitive recording material labels made in accordance with the invention avoid the reduction of "meat bloom" when applied to a package containing red meat.

16 Claims, 2 Drawing Figures

SOLVENT RESISTANT THERMALLY PRINTABLE MATERIAL

BACKGROUND OF THE INVENTION

This invention relates to a heat-sensitive recording material. More particularly, the invention relates to a heat-sensitive material including a hydrophilic and hydrophobic solvent resistant protective layer useful in the manufacture of adhesive-backed heat-sensitive labels. The labels are useful in packaging goods which, in transit, storage, or display, may be exposed to such solvents, e.g., meat, produce, or articles of manufacture commonly exposed to water or oleophilic materials. A bar code or alphanumeric information may be formed on such labels at the point of sale by stamping the label with a thermal printing head.

Known recording materials have a thermally imageable layer comprising a binder, a colorless or pale leuco dye, and an acidic substance that causes the dye to change color upon the application of heat. Labels made from such materials are commonly used in grocery stores, delicatessans, and other points of retail sale of commodities sold by weight. Increasingly, they are also used on many other products. At or prior to a sale the retailer weighs the product, commonly on a machine which integrates a scale, register, and thermal print head, and actuates the machine to deliver a thermally improved label indicating the price, weight, and other information in coded and/or alphanumeric form. The label is then affixed to the product, typically by means of a pressure sensitive adhesive backing layer.

Labels of this type are often exposed to water, fats, or oils which can have an adverse effect on the thermal image, increase background discoloration, and in some cases destroy the machine readability of imprinted bar codes. Also, it has been observed that on occasion such labels cause a discoloration to appear on red meat directly beneath the label.

Several attempts have been made to incorporate in thermally sensitive materials a protective barrier layer which can serve to protect the thermal image from the deleterious effects of solvents. For example, U.S. Pat. No. 4,388,362 to Iwata et al. teaches the application of a water-soluble, resinous protective coat over the heat-sensitive layer. Such layers are necessarily sensitive to hydrophilic solvents. U.S. Pat. No. 4,370,370 suggests adding 20 to 100 weight percent of "water-resisting-property-improvement agents" to the water-soluble resin. The result is a mixed resinous system. Another suggested approach involves employing a carboxylated base resin which may subsequently be ionically cross-linked with solutions of aluminum sulfate, iron sulfate, and the like. Again, such protective layers are necessarily subject to hydrophilic solvents because of the water-soluble character of the materials from which they are made.

It is accordingly desirable to provide an adhesive-backed heat-sensitive recording label whose thermal image is protected from background discoloration that may arise from exposure to oils, fats, water, and plasticizers, and which does not reduce meat bloom.

SUMMARY OF THE INVENTION

In one aspect, the invention features a heat-sensitive recording material comprising a substrate, a heat-sensitive color-producing layer on a first surface of the substrate, and a water-insoluble, covalently cross-linked protective layer over the color-producing layer. An adhesive layer may be applied on the surface of the substrate opposite the color-producing layer. Preferably the adhesive is a pressure-sensitive adhesive and is covered with an adhesive, releasable liner. The color-producing layer comprises a colorless or pale leuco dye, preferably in particulate form, an acidic developer substance to cause the dye to undergo color transformation upon imagewise application of heat to the recording material, polymeric binder material, and an acid-neutralizing (basic) preferably particulate material for reducing background discoloration. The protective layer comprises a water-insoluble polymeric material covalently cross-linked with the aid of an acidic catalyst, and inert filler particles which act as spacer particles in the protective layer.

In preferred embodiments, the color-producing layer has a coating weight of approximately 5.0 to 7.5 grams of solids per square meter and the acid-neutralizing agent is particulate calcium carbonate. The binder is a water-soluble material such as polyvinyl alcohol, and the leuco dye is a fluoran, phthalide, lactone, or triaryl methane dye. The protective layer preferably has a coating weight of approximately 3.0 to 4.0 grams of solids per square meter. The inert filler particles preferably comprises particles of aluminum trihydrate ($Al_2O_3.3H_2O$) having diameters in the approximate range of 0.5 to 3.0 microns. The covalently cross-linked polymeric binder material of the protective layer preferably comprises polyvinyl alcohol cross-linked with melamine formaldehyde in the presence of an acid catalyst, preferably an organic acid catalyst, e.g., fumaric acid. In addition to or instead of fumaric acid, malonic acid, tartaric acid, maleic acid, diglycolic acid, and other carboxylic, sulfonic, or mineral acids may be used.

The recording material preferably also has a second water-insoluble protective layer disposed on the side of the substrate opposite the imaging layer, i.e., between the substrate and adhesive layer if an adhesive layer is employed.

In accordance with another aspect of the invention, it has been discovered that the apparently random occurances of meat discoloration below adhesive labels affixed to red meat products are caused by oxygen depletion beneath the label, and that a label adhered to a package containing meat products which permits sufficient oxygen transport to the myoglobin in the meat beneath the label prevents meat discoloration. Accordingly, the heat-sensitive recording material label for use on red meat preferably has an oxygen permeable substrate, color-producing layer, water-insoluble protective layer, and adhesive layer. The substrate and adhesive layer may be provided with a series of openings arranged to allow oxygen transport therethrough, e.g., at least approximately 4 microscopic holes (approx. 25 microns) per square inch. Alternatively, an oxygen-permeable paper substrate may be used together with an oxygen permeable adhesive, e.g., one filled with inert particles. The thermally-sensitive layer and protective layer or layers are inherently oxygen-permeable.

The currently preferred method of assuring that the adhesive layer is oxygen permeable is to apply an adhesive of the type which contains a volatile solvent to the adhesive layer. Curing or drying of the applied adhesive is then conducted by preferentially driving the solvent out of the exposed surface layers of the adhesive coating. This can be done, for example, by passing the web through a drying apparatus, e.g., a hot air drying tunnel, having a relatively high heat exhange rate so that surface layers of the adhesive coating are dried preferentially. Downstream in the drying tunnel, additional heating drives solvent from the underlayers of the adhesive coating through the dry surface layer, forming a plurality of openings which permit oxygen passage. Subsequently, the abhesive layer and its adhesive coating is laminated onto the back side of the record material with the application of pressure. This results in the formation of numerous, randomly distributed air passageways in the finally cured adhesive layer and an oxygen permeable label suitable for use in the sale of red meat.

The recording material of the invention is manufactured by sequentially applying first and second aqueous dispersions to the substrate. The first dispersion, in addition to the conventional color-forming components and binder, includes acid-neutralizing material to protect the dye from premature reactive exposure to the subsequently applied acidic protective layer. Advantageously, inclusion of the neutralizing agent has been discovered to have no apparent adverse effect on the image density or thermal sensitivity of the acid activated leuco dye, yet serves to minimize development of background discoloration when the protective coat is applied. The second dispersion includes, as essential components, a water-soluble acid cross-linkable resin, e.g., polyvinyl alcohol or other hydroxylated polymer, a cross-linking agent, e.g., formaldehyde, melamine, formaldehyde or polyamide, and an acid for lowering the pH to the range where cross-linking will occur below the temperature at which the imaging layer will develop color. The pH in the environment of the cross-linking reaction which converts the resin to a water-insoluble covalently cross-linked, solvent resistant protective matrix is preferably within the range of 3.5 to 4.5 during in situ curing.

The protective coating and color-forming layer thus cooperate to impart to the recording material improved thermal image stability and resistance to solvent exposure. The oxygen permeable property of the product substantially prevents the occurance of meat discoloration.

It is accordingly an object of the invention to provide a heat-sensitive material having a color-forming layer covered by a water-insoluble layer that protects the thermal image from fading and background discoloration caused by exposure to hydrophobic and hydrophilic solvents. Another object is to provide a heat-sensitive recording material which may be imprinted with a thermal image that consistently can be read by UPC scanning equipment, has a high scanning efficiency, and is characterized by more uniform image density and minimum background discoloration. Another object is to provide a label manufacturing technique which permits covalent cross-linking of a protective layer in situ atop a thermally sensitive imaging layer without prematurely developing the imaging layer. Still another object is to provide such a label for use on red meat products which does not cause meat discoloration.

These and other objects of the invention will be apparent from the description and claims which follow and from the drawing.

DESCRIPTION

Figure 1:
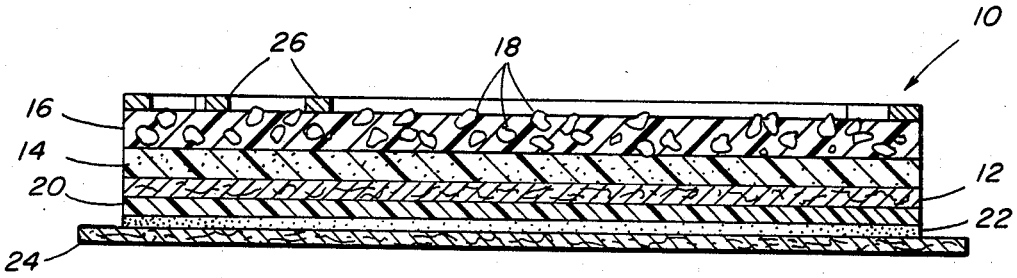
FIG. 1 is a schematic cross-sectional view of a recording label embodying the invention.

Referring to the drawing, FIG. 1 schematically illustrates a label 10 embodying the invention. It comprises a typically medium weight cellulosic substrate 12 weighing between 60 and 70 grams per square meter. Adhered to the top side of the substrate is a heat-sensitive color-forming layer 14 that preferably has a coating weight of approximately 5.0–7.5 grams solids per square meter. Sandwiching layers 12 and 14 are a pair of protective layers 20 and 16. Layer 20 has a covering adhesive layer 22 which in turn is protected until use by abhesive paper layer 24.

Layer 14 comprises an intimate mixture of pale colored or colorless leuco dye, an acidic substance which functions to develop the dye, a polymeric binder material, and a particulate neutralizing agent. It may also include inert filler materials and conventional processing aids such as lubricants, wetting agents, and defoaming agents.

The dye may be of the type generally known in the art which is activated by contact with a proton donating (acidic) substance of a metalated, e.g., zincated, organic acidic material. The preferred dyes are fluoran, lactone, phthalide, or triaryl methane dyes such as crystal violet lactone, 3-N-cyclohexyl, N-methyl amino 6 methyl-7-anilino fluoran, or 3 pyrrolidino-6 methyl-7-anilino fluoran. Many other leuco dyes known to those skilled in the art may be used. The dye is present preferably in particulate form having a particle size between about one to nine microns.

The acidic developer substance comprises an organic acidic material, either monomeric, oligomeric, or polymeric, optionally treated with a metal such as zinc. Examples of materials which may be used include bis phenol A, phenolic condensation products, (either substituted or unsubstituted), and various low melting point organic acids or their esters. The currently preferred developer material is para benzyl hydroxy benzoate.

The polymeric binder, for processing purposes, is preferably at least partly water-soluble. It comprises one or a mixture of resinous materials which serve to hold the other constituents of layer 14 together. On the application of heat, the dye and developer agent come into reactive contact within the binder. The currently preferred binder material is polyvinyl alcohol. Other known binders may also be used such as polyvinyl pyrrolidone, polyacrylamide, or methoxy cellulose.

The neutralizing agent in layer 14 is a basic salt such as calcium carbonate which plays an important role in the manufacture of the completed product as discussed hereinafter. It preferably comprises a neutral colored, water-insoluble particulate material, and is preferably present at levels on the order of three percent by weight of the dry thermal coating.

In addition to the foregoing, layer 14 may also include inert fillers, lubricants, dispersants, and defoaming agents present in minor amounts as processing aids.

Adhered to thermally sensitive color forming layer 14 is a substantially water-insoluble, covalently cross-linked, oxygen-permeable protective layer 16. Its function is to maintain the contrast and readability of thermal images imprinted in layer 14 despite exposure to oils, fats, water, plasticizing materials and the like which may contact the label. Layer 16 is formed in situ from a resin which is cross-linked covalently at room temperature or a higher temperature (provided the higher temperature is insufficient to develop the leuco dye) with a cross-linking agent in an acidic environment. The protective layer's properties of water-insolubility and insolubility in other solvents such as fats and oils are directly traceable to the covalent cross-links formed in situ during manufacture of the product of the invention. Preferably, the resinous components of layer 16 comprise a major amount of a water-soluble binder, e.g., polyvinyl alcohol or other hydroxylated resin, cross-linked with melamine formaldehyde or another material reactive under acid conditions with the resin's hydroxy groups.

Layer 16 preferably has a coating weight of approximately 3–4 grams per square meter and includes inert filler particles 18 which act as spacer particles. Without the spacer particles 18, the thermal printing head tends to strip away the protective layer 16 upon contact, leaving the thermal image within the layer 14 exposed. A preferred filler is alumina trihydrate, ground to a particle size in the range of about 0.5 to 3.0 microns in diameter.

The binder of layer 16 preferably comprises a major amount of polyvinyl alcohol cross-linked with a minor amount of melamine-formaldehyde. It has been found that cross-linking of the coating is optimized at room temperture (70° F.) when the pH of the applied mixture is within the range of about 3.5 to 4.5. At pH levels above about 4.5, the cross-linking reaction slows considerably, and at a pH of 6 the resin essentially will not cross-link at room temperature. Therefore, an acidic substance is added in sufficient quantity to achieve a pH in the coating composition to be applied no greater than approximately 3.0. Upon application of the coating mix and exposure to the neutralizing agent, its pH rises to the desired optimum range of 3.5 to 4.5. A preferred acidic substance is a dibasic carboxylic acid such as fumaric acid.

During manufacture of the recording material, the addition of the acidic substance into the protective layer coating, which is applied directly onto the color forming layer 14, could allow the acid to come into direct contact with the leuco dye within the color-forming layer, causing discoloration in the background of a thermal image within the layer 14. It has been discovered that a basic, acid-neutralizing agent added to the color forming layer 14 acts to prevent premature acidic development and resulting background discoloration. However, it does not substantially interfere with the action of the acidic developer substance on the leuco dye during thermal imaging. Thus, the neutralizing agent in combination with pH control permits the in situ formation of a covalently cross-linked, solvent resistant protective coating without simultaneously developing the heat and acid sensitive imaging layer.

Label 10 also preferably includes a water-insoluble lower protective layer 20, coated on the substrate 12 on the opposite side from the color-forming layer 14. Layer 20 protects the color forming layer 14 from contaminants such as oils, water, and plasticizers that might rise from the package to which the label 10 is adhered. The lower protective layer 20 may be similar or identical in composition to the protective layer 16, i.e., may comprise a water-insoluble covalently cross-linked resin with or without an inert filler.

A pressure-sensitive or other type of adhesive layer 22 may be formed on lower protective layer 20 in a conventional manner and covered by an adhesive releasable liner 24. Abhesive liner 24 may comprise paper coated with silicone or another suitable abhesive material. The preferred method of applying the adhesive coating and abhesive liner is set forth below.

It is often desirable to print a brand name 26 or the like on the label 10. Water-soluble inks for this purpose are subject to smudging and running upon exposure to water and oils. Accordingly, it is possible to print with an ink comprising conventional pigmenting materials and an acid cross-linkable binder such as that used in protective layer 16, i.e., a polyvinyl alcohol binder cross-linked with melamine-formaldehyde in the presence of an acid. Conventional inks may also be used.

Since it has been discovered that an oxygen-impermeable label may cause the oxymyoblobin in red meat products to deoxygenate to myoglobin, resulting in meat discoloration, it is preferable that the label be oxygen-permeable.

The above described layers 14, 16, and 20 are inherently oxygen-permeable because of their composition and coating weight. The oxygen-permeation properties of substrate 12 can be controlled by selection of the substrate used. Most papers are sufficiently gas-permeable to avoid the meat discoloration problem.

Figure 2:
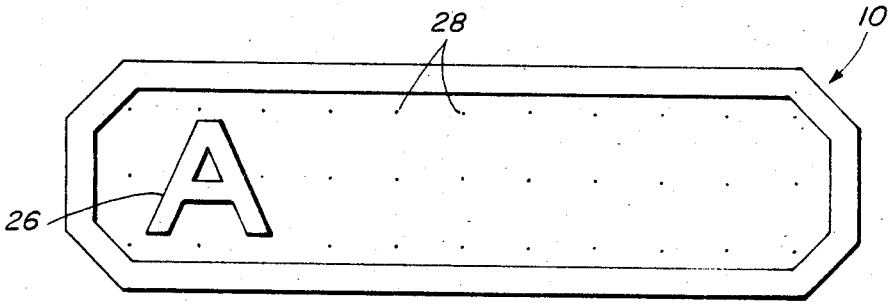
FIG. 2 is a plan view of the front side of the label of FIG. 1.

As shown in FIG. 2, oxygen permeability may be achieved by providing an array of microscopic holes 28 through the area of the label 10. The holes can be formed, for example, by punching at least adhesive layer 22 with an array of pins (not shown) having a density that is adequate to allow sufficient oxygen diffusion through the layer 22. Hole punching may conveniently be conducted during die cutting of the labels from a sheet of the label material. A density of 4 holes (on the order of 25 microns each) per square inch of the surface of the adhesive layer 22 is normally sufficient.

Another method of promoting oxygen permeability of the adhesive coating is to fill the adhesive with inert spacer or filler particles. For example, alumina trihydrate particles or talc particles of 1–3 microns average diameter blended into the adhesive at 5% to 10% by weight do not seriously adversely affect the adhesive properties of the blend, but do result in a significant increase in oxygen permeability.

Another method of assuring that the adhesive layer is oxygen permeable involves control of the drying technique used to cure the adhesive. An adhesive composition, for example, a commercially available adhesive composition such as an acrylic, synthetic or natural rubber, or acrylate-acetate copolymer-based adhesive, is applied by conventional methods to an adhesive backing. The coated adhesive web is then subjected to heat so as to rapidly drive off the solvent from surface layers of the adhesive coating, resulting in a dry surface film. Subsequent application of heat boils out solvent from the interior of the adhesive coating, rupturing the surface layer and forming holes. The adhesive layer with its cured adhesive coating is then laminated onto the back side of the record material. The application of laminating pressure promotes the formation of an oxygen permeable adhesive matrix.

The invention will be further understood from the following non-limiting examples wherein all parts are by weight.

EXAMPLES

The approach to production of the thermally sensitive layer is to prepare a first dispersion containing the leuco dye and other ingredients set forth below (Mix A), prepare a second dispersion comprising the acidic developer material and particulate neutralizing agent (Mix B), mix the dispersions, and apply the product to the substrate.

| Preparation of the Color Forming Layer | Part |
|---|---|
| Mix Dispersion A | |
| Polyvinyl alcohol (approx. 10% solution) | 110 parts |
| 3-N—cyclohexyl, N—methyl amino-6-methyl-7-anilino fluoron | 50 parts |
| Defoamer | 0.1 part |
| Water | 140 parts |
| Mix Dispersion A' | |
| Polyvinyl alcohol (approx. 10% solution) | 100 parts |
| Crystal Violet Lactone | 60 parts |
| Defoamer | 0.1 part |
| Water | 160 parts |
| Mix Dispersion A" | |
| Carboxy methyl cellulose (approx. 10% solution) | 110 parts |
| 3 Pyrrolidino-6 methyl-7 anilino fluoran | 55 parts |
| Defoamer | 0.1 parts |
| Water | 145 parts |

Mix A, A' and A" may be prepared by first dispersing the ingredients in the water using a Baranco mixer for 15 minutes, and then reducing the particle size by way of attrition for 60 minutes.

| Mix Dispersion B | |
|---|---|
| Polyvinyl alcohol (approx. 10% solution) | 100.0 parts |
| Water | 140.0 parts |
| Dispersing agent | 2.0 parts |
| Zinc stearate | 10.0 parts |
| Alumina trihydrate | 27.5 parts |
| p-Benzyl-hydroxy-benzoate | 20.0 parts |
| Calcium carbonate | 2.5 parts |
| Mix Dispersion B' | |
| Polyvinyl alcohol (approx. 10% solution) | 100 parts |
| Water | 140 parts |
| Dispersing agent | 2 parts |
| Stearamide (steric acid amide) | 10 parts |
| Talc | 28 parts |
| Bis phenol A | 20 parts |
| Calcium carbonate (particulate) | 3 parts |

The B or B' mix may be prepared by dispersing the ingredients using a mixer for 15 minutes after all of the dry components are added together. The ingredients are added to the mix tank in the order shown above. The particle size is reduced by attriting for 30 minutes.

Any one of the "A" mix dispersions may be combined with either of the "B" mix dispersions at a ratio of 5 to 15 parts A per 50 parts B. The blend is then coated onto paper e.g., 40 pound (24×36) and dried to produce a dry coating weight of approximately 6 grams per square meter.

| Preparation of the Protective Layers | |
|---|---|
| C Mix solution | |
| Water | 2800.0 parts |
| Polyvinyl alcohol | 60 parts |
| Fumaric Acid | 20 parts |
| C' Mix | |
| Water | 2800 parts |
| Polyvinyl alcohol | 60 parts |
| Maleic acid | 20 parts |
| C" Mix | |
| Water | 2800 parts |
| Polyvinyl alcohol | 60 parts |

-continued

| Preparation of the Protective Layers | |
|---|---|
| Diglycolic acid | 20 parts |

These solutions are made in a steam jacketed kettle with continuous stirring. The kettle is filled with the appropriate amount of water, then the polyvinyl alcohol is added slowly while the water remains cold. The temperature is brought up to 180° to dissolve the polyvinyl alcohol. After 30 minutes, when the polyvinyl alcohol is dissolved, the acid is added. The mix is stirred for 30 additional minutes while heating to dissolve the acid. The mix is then cooled to 90° F.

| "D" Mix Dispersion | |
|---|---|
| Mix C, C' or C" | 400.0 parts |
| Wetting agent | 0.4 parts |
| Alumina trihydrate | 11.2 parts |

The ingredients are added to a 55-gallon drum containing the Mix C, C' or C" in the order shown above. The alumina trihydrate is uniformly dispersed using a Shar mixer for 30 minutes to produce a dispersion having an average particle size of about 0.8 microns and a pH of 2.3–2.4.

| "E" Mix Dispersion | |
|---|---|
| "D" Mix | 410 parts |
| Melamine-formaldehyde resin (80% solids) | 4–8 parts |

The melamine-formaldehyde resin is stirred into the "E" mix dispersion using a Shar mixer. The resulting solution has a pH of about 2.9. It is coated over the above-described color-forming layer and on the underside of the paper, and is then allowed to dry and cross-link at a pH which is typically in the range of 3.5–4.5. The dry coating has a coating weight of approximately 3–4 grams per square meter. No significant discoloration of the color-forming layer is observed.

Thermally imprintable paper made in accordance with the foregoing process has a low background discoloration. Bar codes or alphanumeric characters may be imprinted using conventional thermal printing heads and will produce imprinted marks having outstanding contrast. Water, fats and oils do not seriously adversely affect the imprinted marks because the covalently cross-linked barrier coatings are insoluble in both hydrophobic and hydrophilic solvents. The product is oxygen-permeable.

An adhesive layer may be applied to the back side of the product using conventional techniques. If the labels are intended for use on red meat products, then holes can be formed in at least the adhesive layer to prevent meat discoloration. This step may advantageously be conducted together with the label diecutting step. Alternatively, the adhesive layer may be filled with 5% to 10% by weight particulate filler using conventional procedures. Alumina trihydrate and talc are two examples of fillers which may be used; a 1–3 micron average particle size is preferred, but larger particles are also operative. The adhesive layer is preferably applied at a coating weight of 18–23 g/m$^2$. Useful adhesives are commercially available from, for example, Monsanto and National Starch and Chemical Corporation. Solutions or dispersions of acrylic, synthetic or natural rubber, and acrylate-acetate copolymer-based adhesive compositions work well.

One useful method for coating an oxygen-permeable adhesive layer is set forth below. An acrylic-based adhesive composition from National Starch is coated onto an adhesive sheet comprising silicone coated paper at a coating weight of approximately 20 g/m$^2$. The coated web is passed through a drying tunnel which blows hot air against the coating surface of the web so that the solvent is driven off in surface layers of the coating to produce a dried surface layer. As the web passes through the tunnel, solvent beneath the dry layer boils off forming a multiplicity of holes in the dry surface of the coating. The cured adhesive with its abhesive web is then applied to the back side of the thermally-sensitive product and passed through the nip of a pair of rollers which exert a pressure of 10–30 psi. This results in the production of a label which, after exposure of the adhesive by removal of the adhesive sheet and application to, e.g., shrink-wrapped meat, will be oxygen-permeable and will not lead to meat discoloration beneath the label.

The invention may be embodied in other specific forms without departing fromm the spirit and scope thereof.

Other embodiments are within the following claims.

What is claimed is:

1. A heat-sensitive recording material resistant to background discoloration and image fading induced by exposure to hydrophobic and hydrophilic solvents, said material comprising:

A. a substrate;

B. a thermally imagewise imprintable color-producing layer affixed to a first surface of said substrate comprising a leuco dye developable upon exposure to an acidic developer material, an acidic developer, a binder material for said dye and developer, and a basic, particulate, neutralizing agent; and C. a water-insoluble protective layer affixed to said color-producing layer, comprising an organic acid-catalyzed, covalently cross-linked resin containing dispersed spacer particles.

2. The recording material of claim 1 further comprising an adhesive layer affixed to a second surface of said material opposite said first surface.

3. The material of claim 2 further comprising a resinous protective layer affixed to said substrate on a surface opposite said first surface.

4. The material of claim 2 wherein said adhesive layer comprises a pressure-sensitive adhesive, said material further comprising a removable abhesive layer affixed to said pressure-sensitive adhesive layer.

5. The material of claim 2 wherein said layers are oxygen permeable.

6. The material of claim 2 wherein said adhesive layer comprises an adhesive filled with spacer particles, said adhesive layer being oxygen permeable.

7. The material of claim 2 wherein said adhesive defines a multiplicity of air passages extending therethrough in directions normal to surface of said substrate.

8. The material of claim 1 further comprising printed indicia affixed to said protective layer and comprising a water-soluble ink comprising a pigment and an organic acid catalyzed covalently cross-linkable resin binder.

9. The material of claim 1 wherein said color-producing layer comprises a dye selected from the group consisting of fluoran dyes, triaryl methane dyes, lactone dyes, and phthalide dyes, and said binder comprises polyvinyl alcohol.

10. The material of claim 1 wherein said neutralizing agent comprises particulate calcium carbonate.

11. The material of claim 1 wherein said acid catalyzed covalently cross-linked resin comprises an organic acid catalyzed, melamine formaldehyde cross-linked, polyvinyl alcohol resin.

12. The material of claim 1 wherein the coating weight of said color-producing layer is within the range of 5.0 to 7.5 grams per square meter and of said protective layer is within the range of 3.0 to 5.0 grams per square meter.

13. The material of claim 1 wherein said color-producing layer comprises a fluoran dye, said binder comprises polyvinyl alcohol, said neutralizing agent comprises calcium carbonate and said organic acid-catalyzed covalently cross-linked resin comprises organic acid catalyzed melamine-formaldehyde cross-linked polyvinyl alcohol resin.

14. A heat sensitive recording material for labeling packaged red meat products comprising an oxygen permeable layered material comprising a substrate, a thermally imagewise imprintable color-producing layer affixed to a first surface of said substrate, a resinous, water-insoluble, organic acid-catalyzed covalently cross-linked protective layer affixed to said color-producing layer for protecting said color-producing layer from the adverse effects of solvents, and an adhesive layer affixed to said substrate opposite said color-producing layer.

15. The material of claim 14 wherein said adhesive layer defines a plurality of randomly dispensed openings sufficient to permit oxygen flow therethrough.

16. The material of claim 14 wherein said adhesive layer comprises an oxygen permeable adhesive composition filled with inert spacer particles.

* * * * *